US008776771B1

(12) United States Patent
Yang et al.

(10) Patent No.: US 8,776,771 B1
(45) Date of Patent: Jul. 15, 2014

(54) PNEUMATIC GUN AND EXTENSION BARREL

(71) Applicant: Green Science Laboratory Inc., Taoyuan County (TW)

(72) Inventors: Shih-Horng Yang, Taoyuan (TW); Tien-Wei Sun, Taoyuan (TW)

(73) Assignee: Green Science Laboratory Inc., Taoyuan (TW)

( * ) Notice: Subject to any disclaimer, the term of this patent is extended or adjusted under 35 U.S.C. 154(b) by 32 days.

(21) Appl. No.: 13/778,288

(22) Filed: Feb. 27, 2013

(51) Int. Cl.
*F41B 11/60* (2013.01)
*F41B 11/70* (2013.01)
*F41A 21/06* (2006.01)

(52) U.S. Cl.
CPC ..... *F41B 11/70* (2013.01); *F41B 11/60* (2013.01); *F41A 21/06* (2013.01)
USPC ..... 124/71; 42/77

(58) Field of Classification Search
CPC ..... F41B 11/60; F41B 11/70; F41B 11/00; F41A 21/06
USPC ..... 124/71; 42/77
See application file for complete search history.

(56) References Cited

U.S. PATENT DOCUMENTS

| | | | | |
|---|---|---|---|---|
| 3,472,218 | A * | 10/1969 | Mers | 124/67 |
| 3,726,266 | A * | 4/1973 | Palmer | 124/59 |
| 6,546,874 | B2 * | 4/2003 | Vasel et al. | 102/444 |
| 7,752,974 | B2 * | 7/2010 | Wenaas et al. | 102/367 |
| 8,701,325 | B1 * | 4/2014 | Rayner | 42/76.01 |
| 2006/0042615 | A1 * | 3/2006 | Gregory | 124/62 |
| 2009/0314272 | A1 * | 12/2009 | Lin | 124/48 |
| 2010/0275895 | A1 * | 11/2010 | Wenaas et al. | 124/74 |
| 2012/0132187 | A1 * | 5/2012 | Murray | 124/77 |
| 2012/0180361 | A1 * | 7/2012 | Scarr | 42/76.01 |

* cited by examiner

*Primary Examiner* — Michael David
(74) *Attorney, Agent, or Firm* — Jackson IPG PLLC

(57) ABSTRACT

The present invention relates to an extension barrel, which comprises an outer tube and a dye coating module. The outer tube is provided at the rear end thereof with a connector portion adapted for connection to a front end of a pneumatic gun. The dye coating module is mounted within the outer tube, so that a bullet projected from the pneumatic gun is coated with dye having a desired color when passing through the dye coating module. As a result, the object hit by the bullet is stained with the color and can be easily identified.

12 Claims, 9 Drawing Sheets

PNEUMATIC GUN AND EXTENSION BARREL

BACKGROUND OF THE INVENTION

1. Field of the Invention

The present invention relates to an extension barrel and, more particularly, to an extension barrel adapted for connection to a pneumatic gun and being capable of coating the bullets projected from the pneumatic gun with a desired color for identification purpose.

2. Description of the Prior Art

Paintball game has been considered as an adrenaline sport, in which players compete, in teams or individually, to eliminate opponents by shooting paintballs or BB bullets from a pneumatic gun (commonly referred to as a paintball gun). The game simulates battlefield combat, where some players attack or defend against other players in a virtually real manner.

Rules for playing paintball vary, but can be roughly categorized into those for professional competitions and those for recreational contests. In a professional paintball competition, players are typically divided into two teams which occupy similar game fields scattered with similar terrains and bunkers, and the game is governed by a sound and complete set of rules and officiated by qualified referees. Depending on the rules, a professional paintball game can be played by two teams of five, seven or ten players, with the sevens being the most popular format worldwide. In order to catch up this trend, all of the tournaments organized or sponsored by the Chinese Taipei Paintball Game Association are now played by teams of seven players.

The recreational contests are normally taken place for pure leisure purposes. An amateur player may simply team up with himself or with various numbers of friends to constitute a paintball team of one, five, seven, ten or even more than one-hundred player (s) to fight against other teams. The rules for a recreational contest are relatively soft and free-style, so long as every player wears protective equipments and has a good time.

In either case of professional competition or recreational contest, players are required to wear protective masks and equipped with pneumatic guns. The pneumatic gun is mounted with a compressed $CO_2$ tank, so that a player may release the $CO_2$ propellant by pulling the trigger of the pneumatic gun to propel paintballs or BB bullets through the barrel. Win or loss of the game is normally determined by wiping out the opponents.

The conventional paintballs used as the ammunition for the pneumatic gun typically have a brittle shell that encapsulates dye and tends to break upon impact. Therefore, the objects hit by the paintballs will be tagged with dye and can be easily identified. However, this dye-filled spherical structure is much less than ideal in view of its complexity in structure and difficulty in manufacture.

The commonly used BB bullets are made of plastics or ceramics. They are unsatisfactory for use in paintball games, since their volume is too limited to accommodate dye material. As a consequence, the objects hit by the BB bullets cannot be tagged with dye and can hardly be identified.

SUMMARY OF THE INVENTION

An object of the invention is to provide an extension barrel adapted for connection to a pneumatic gun and being capable of coating the bullets projected from the pneumatic gun with a desired color for identification purpose.

In order to achieve the object described above, the extension barrel according to the invention comprises an outer tube and a dye coating module. The outer tube is provided at the rear end thereof with a connector portion adapted for connection to a front end of a pneumatic gun. The dye coating module is mounted within the outer tube.

Therefore, a bullet projected from the pneumatic gun is coated with dye having a desired color when passing through the dye coating module. As a result, the object hit by the bullet is stained with the color and can be easily identified.

By virtue of the structural arrangement described above, the extension barrel disclosed herein successfully achieves the following advantageous effects.

1. The invention is adapted for directly coating a dye layer on the bullet, rather than using the conventional dye-filled paintballs with higher structural complexity.

2. When the bullet hits an object, the dye layer coated on the bullet will somewhat transfer to the object, allowing the user to easily confirm the hit.

3. The extension barrel can be easily coupled to a pneumatic gun by the user.

BRIEF DESCRIPTION OF THE DRAWINGS

The above and other objects, features and effects of the invention will become apparent with reference to the following description of the preferred embodiments taken in conjunction with the accompanying drawing, in which.

DETAILED DESCRIPTION OF THE PREFERRED EMBODIMENTS

Figure 1:
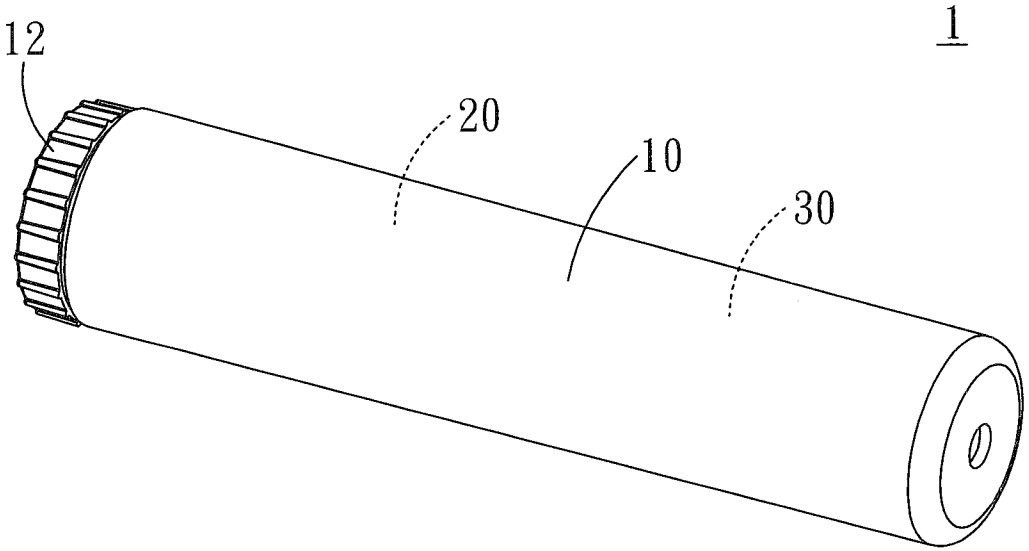
FIG. 1 is a perspective view of the extension barrel according to a preferred embodiment of the invention.
Figure 2:
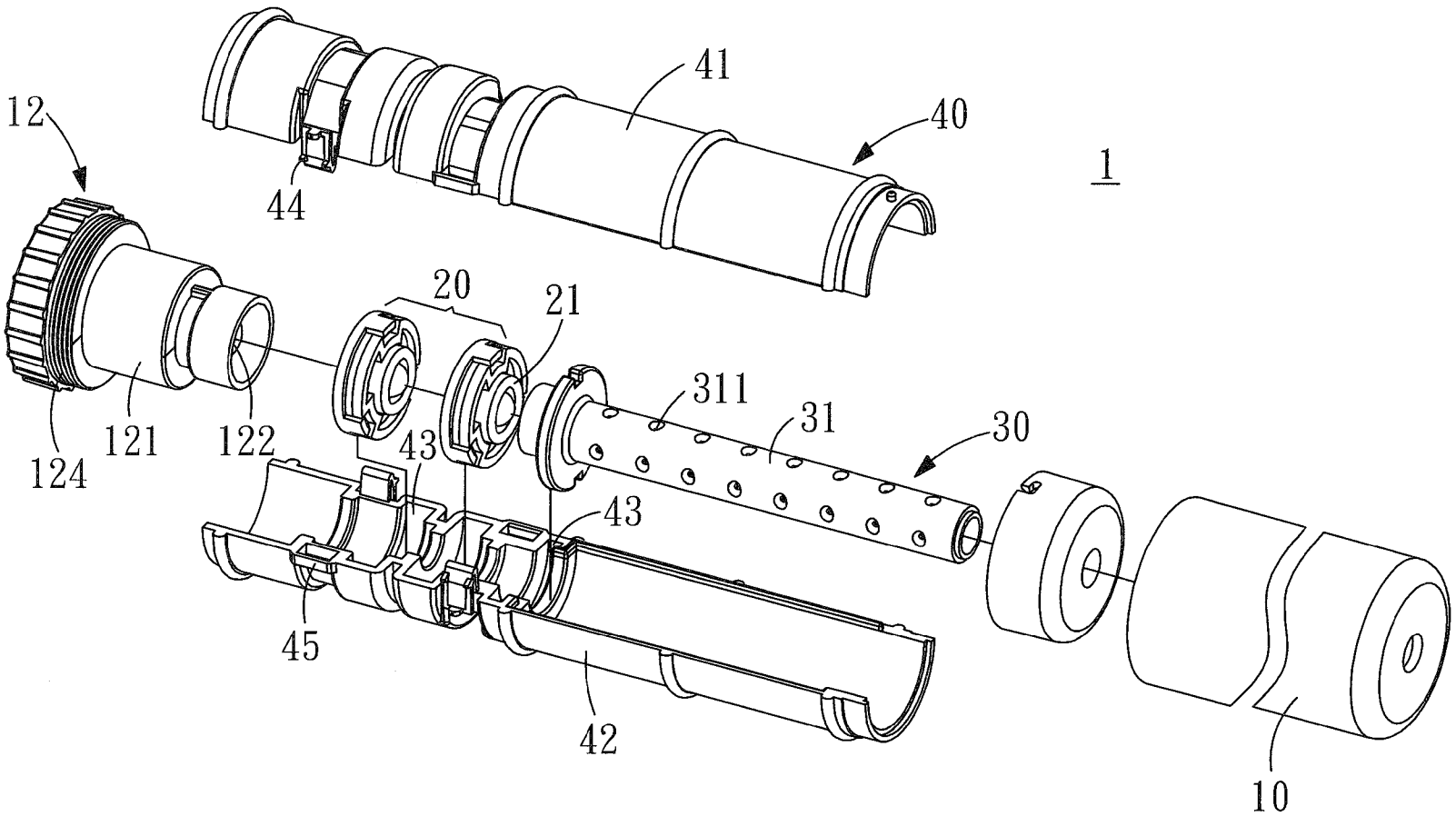
FIG. 2 is an exploded view of the extension barrel according to a preferred embodiment of the invention.
Figure 3:
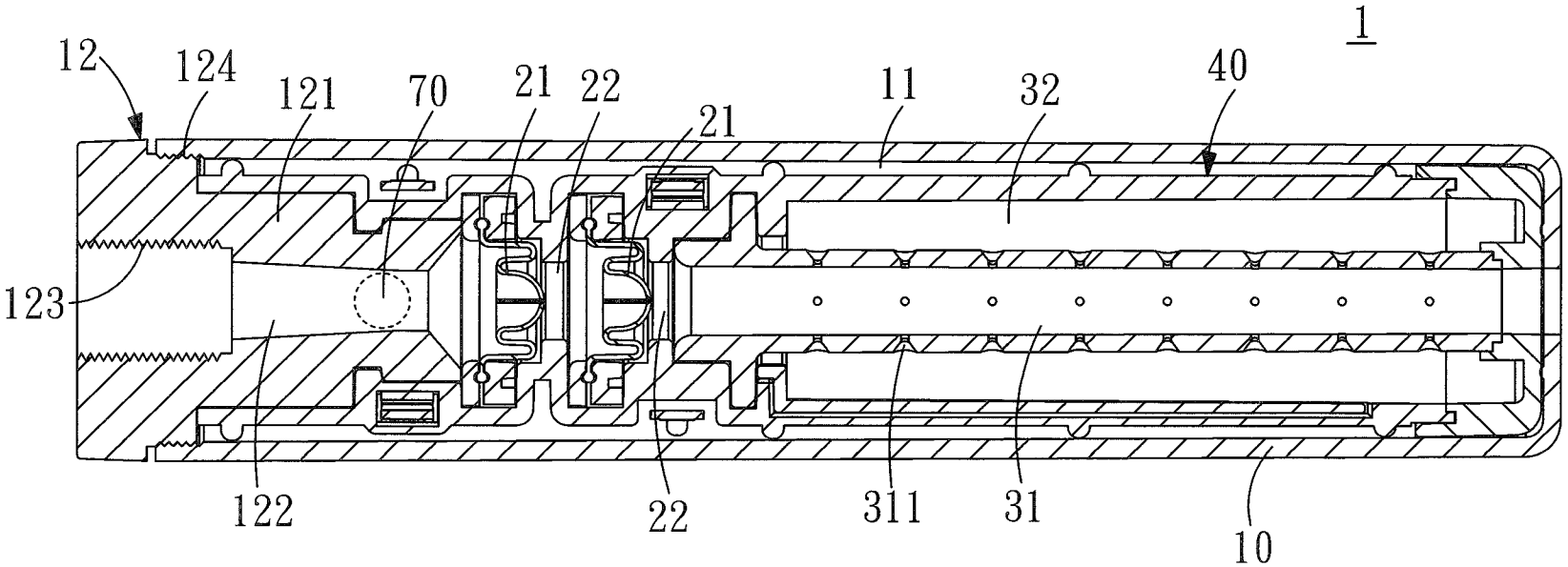
FIG. 3 is a cross-sectional view of the extension barrel according to a preferred embodiment of the invention.

FIG. 1 is a perspective view of the extension barrel according to a preferred embodiment of the invention. FIG. 2 is an exploded view of the extension barrel according to a preferred embodiment of the invention. FIG. 3 is a cross-sectional view of the extension barrel according to a preferred embodiment of the invention. As shown in the drawings, the extension barrel 1 according to the invention comprises an outer tube 10, a unidirectional check module 20 and a dye coating module 30.

The outer tube 10 includes a front end and a rear end and defines an internal space 11 connecting the front end to the rear end. The outer tube 10 is provided at the rear end thereof with a connector portion 12. The connector portion 12 comprises a base 121 and defines a through hole 122 connecting to the internal space 11. The through hole 122 is provided with internal threads 123, whereas the base 121 is provided with external threads 124 for engaging the outer tube 10.

Figure 4:
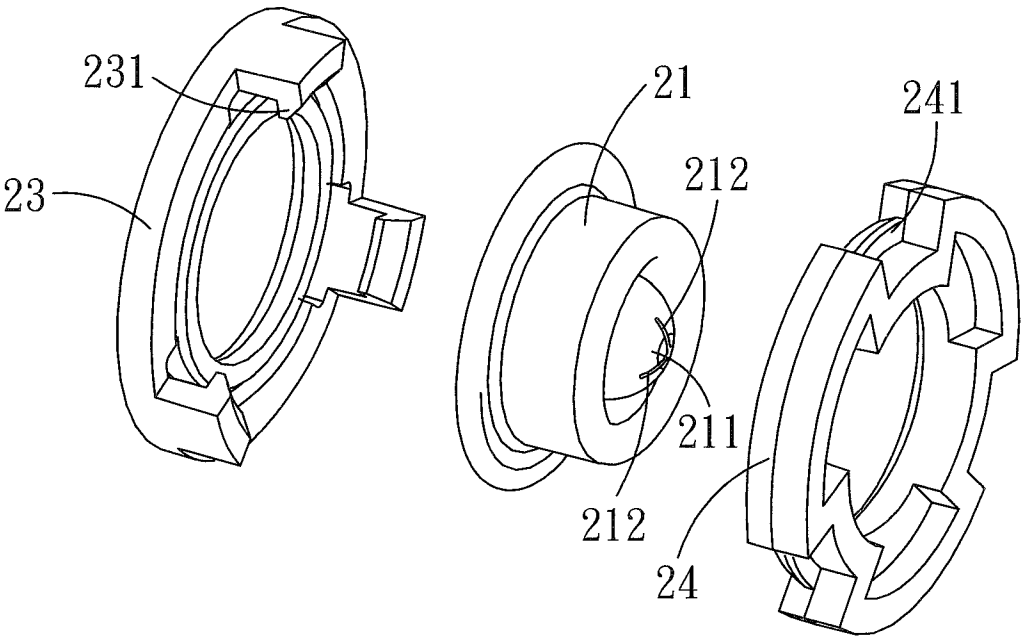
FIG. 4 is an exploded view of the unidirectional check module according to a preferred embodiment of the invention.

The unidirectional check module 20 is mounted within the internal space 11 and installed in front of the connector portion 12. The unidirectional check module 20 comprises at least one backflow-proof filter 21, preferably made of rubber material. According to the preferred embodiment disclosed herein, the unidirectional check module 20 is divided into several compartments 22 by two backflow-proof filters 21. As shown in FIG. 4, each of the backflow-proof filters 21 comprises a convex portion 211 protruding toward the front end of the outer tube and formed with radially arranged incisions 212. The unidirectional check module 20 further comprises a first fastener member 23 provided with one or more third clip portions 231 and a second fastener member 24 provided with one or more fourth receiver portions 241. The respective third clip portions 231 are received by and engage the respective fourth receiver portions 241, so that the backflow-proof filter 21 is sandwiched in position between the first fastener member 23 and the second fastener member 24.

The dye coating module 30 is mounted within the internal space 11 and installed in front of the unidirectional check module 20. The dye coating module 30 comprises a bullet passage tube 31 and a dye powder reservoir 32 surrounding the bullet passage tube 31. The bullet passage tube 31 is disposed in communication with the dye powder reservoir 32 via a plurality of apertures 311, and the dye powder reservoir 32 contains dye powder with a desired color.

Figure 5:
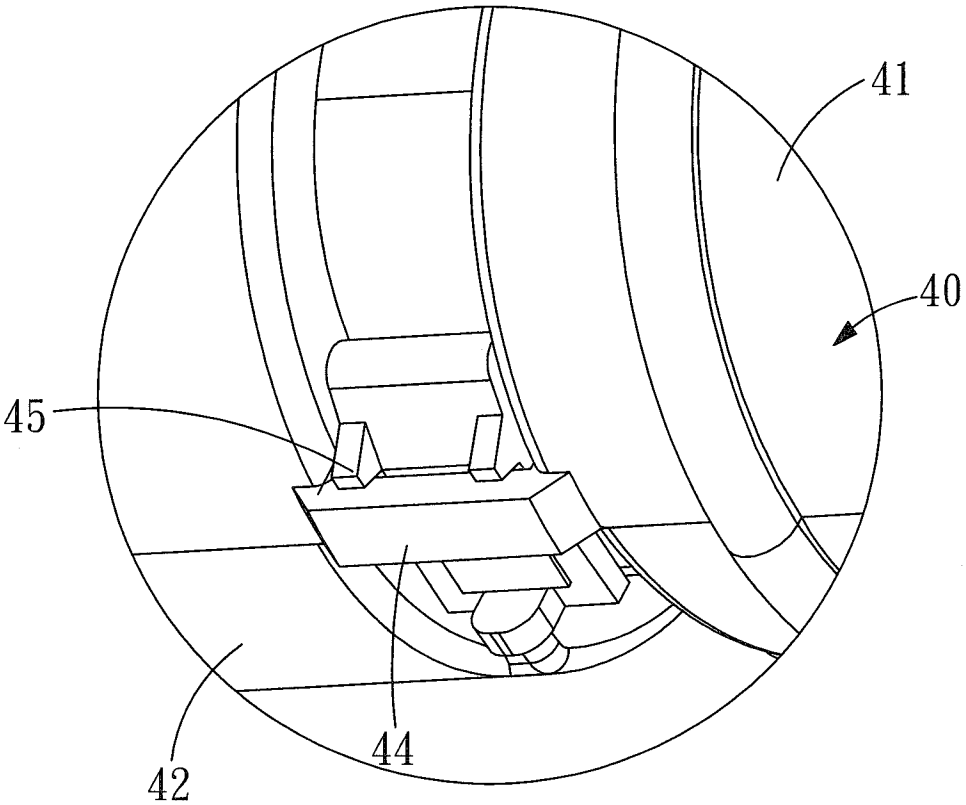
FIG. 5 is a partially enlarged view of the inner tube according to a preferred embodiment of the invention.

The extension barrel 1 further comprises an inner tube 40 sleeved inside the outer tube 10. The unidirectional check module 20 and the dye coating module 30 are mounted within the inner tube 40, so that the inner tube 40 and the bullet passage tube 31 cooperatively define the dye powder reservoir 32. The inner tube 40 includes an upper half 41 and a lower half 42, both being formed on the inner walls thereof with recesses 43 for positioning the unidirectional check module 20 and the bullet passage tube 31. The upper half 41 is coupled to the lower half 42 by a buckle element. As shown in FIG. 5, the buckle element may by way of example comprise one or more first clip portions 44 and one or more second receiver portions 45. The respective first clip portions 44 are received by and engage the respective receiver portions 45, so that the unidirectional check module 20 and the dye coating module 30 are secured within the space defined by the upper half 41 and a lower half 42.

Figure 6:
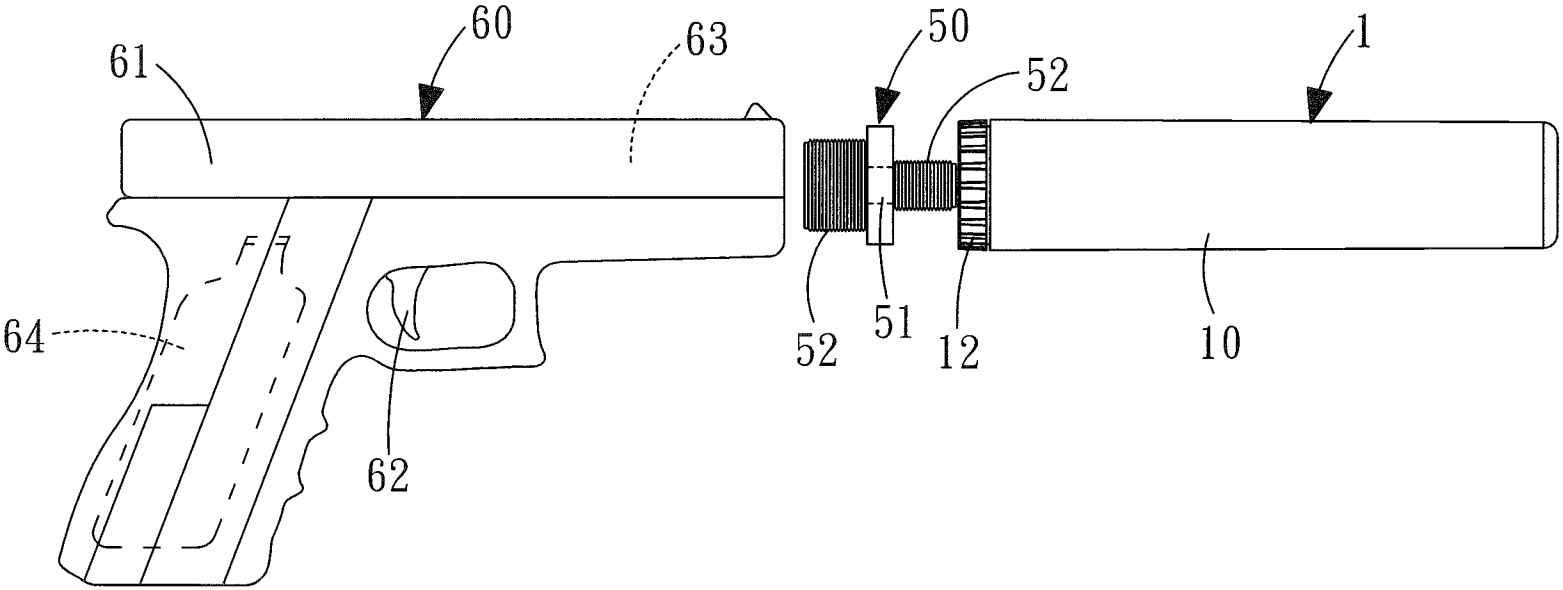
FIG. 6 is a schematic diagram showing the coupling of the extension barrel to a pneumatic gun according to a preferred embodiment of the invention.

In practice, the extension barrel 1 disclosed herein may be coupled to the front end of a pneumatic gun 60 via an adapter 50, as shown in FIG. 6. The pneumatic gun 60 comprises a gun body 61, a trigger 62 pivotally mounted to the gun body 61, a gun barrel 63 extending from the gun body 61, and a gas tank 64 installed within the gun body 61. The trigger 62 is connected to and cooperates with the gun barrel 63 to project bullets. The adapter 50 has two end portions, both being provided with external threads 52 for engaging the connector portion 12 of the extension barrel 1 and the free end of the gun barrel 63, respectively. The adapter 50 is also formed with a through hole 51 connecting the two end portions. This arrangement allows the user to readily couple the extension barrel 1 to the pneumatic gun 60.

Figure 7:
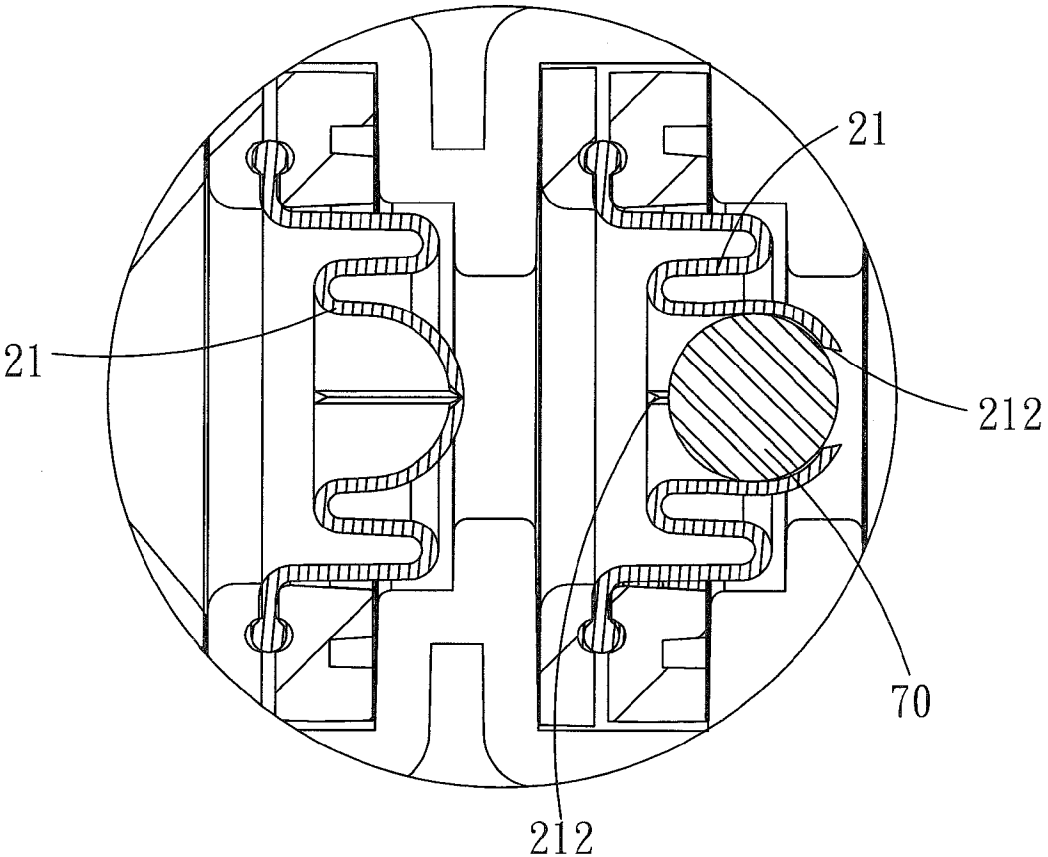
FIG. 7 is a schematic diagram showing that a bullet is passing through the unidirectional check module according to a preferred embodiment of the invention.

When the user pulls the trigger 62, the compressed gas loaded within the gas tank 64 is released and propel the bullet 70 located in the gun barrel 63 towards the extension barrel 1. As shown in FIGS. 3 and 7, the bullet 70 then sequentially passes through the through hole 122 of the connector portion 12 and the unidirectional check module 20. At the time, the bullet 70, upon being propelled by the gas, pushes the backflow-proof filter to open up. After the bullet 70 passes through, the backflow-proof filter 21 immediately closes up to prevent dye powder from entering the gun barrel 63.

Figure 8:
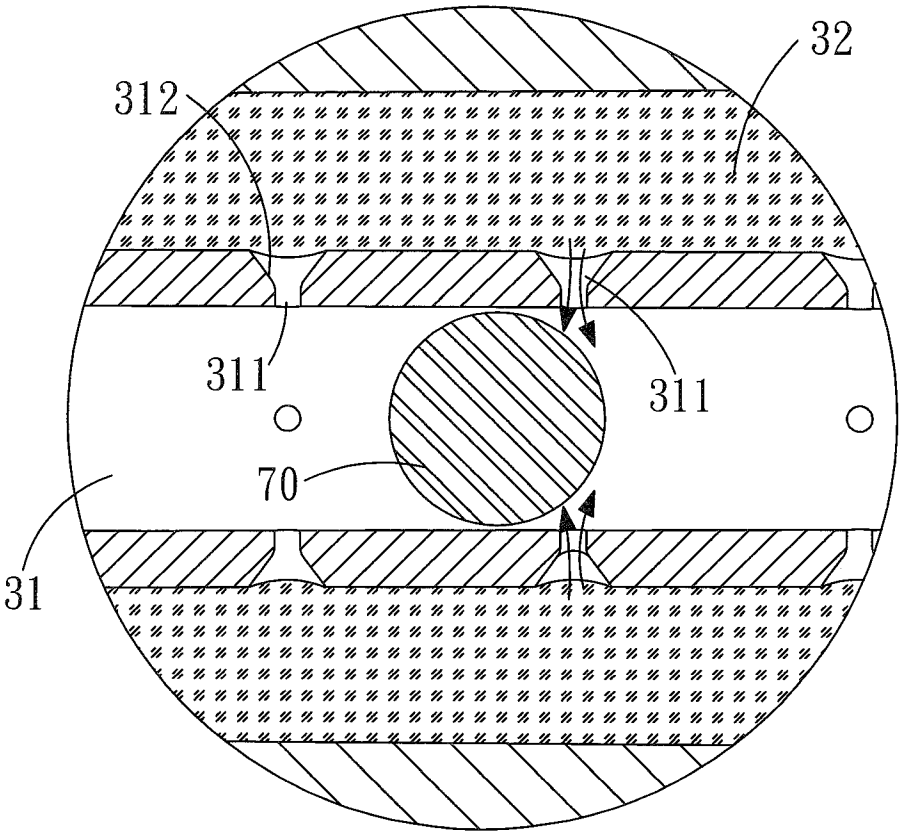
FIG. 8 is a schematic diagram showing that a bullet is passing through the dye coating module according to a preferred embodiment of the invention.
Figure 9:
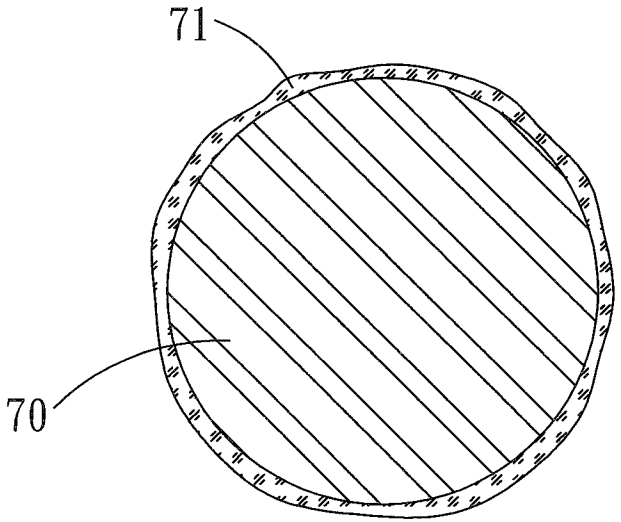
FIG. 9 is a schematic view of a bullet coated with a dye layer.

As shown in FIG. 8, the bullet 70 induces a negative pressure when passing through the bullet passage tube 31, making some of the dye powder loaded within the dye powder reservoir 32 travel across the apertures 311 and get into the bullet passage tube 31. The dye powder adheres on the bullet 70, so that the bullet 70 is coated with a dye layer 71, as shown in FIG. 7. Preferably, the apertures 311 may be shaped into a funnel form 312 having a larger opening at the dye powder reservoir 32 as compared with the opposite opening at the bullet passage tube 31, thereby facilitating the coating of dye powder. Moreover, the bullet 70 would accumulate electrostatic charge on its surface when passing through the backflow-proof filter 21, so that the dye layer 71 is firmly adhered onto the bullet 70 due to electrostatic attraction.

By virtue of the structural arrangement described above, the extension barrel disclosed herein is adapted for directly coating a dye layer on the bullet, rather than using the conventional dye-filled paintballs with higher structural complexity. If the bullet hits an object, the dye layer coated on the bullet would somewhat transfer to the object, allowing the user to easily confirm the hit. In addition, the extension barrel is provided with a backflow-proof filter to prevent dye powder from entering the pneumatic gun, so as to avoid any contamination to the pneumatic gun.

In conclusion, the extension barrel disclosed herein can surely achieve the intended objects and effects of the invention by virtue of the structural arrangement described above. While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit of the invention and the scope thereof as defined in the appended claims.

What is claimed is:

1. An extension barrel comprising:

an outer tube having a front end and a rear end and defining an internal space connecting the front end to the rear end, the outer tube being provided at the rear end thereof with a connector portion formed with a through hole connecting to the internal space; and a dye coating module mounted within the internal space and installed in front of a unidirectional check module, the dye coating module comprising a bullet passage tube and a dye powder reservoir surrounding the bullet passage tube, wherein the bullet passage tube is disposed in communication with the dye powder reservoir via a plurality of apertures.

2. The extension barrel according to claim 1, wherein the extension barrel further comprises the unidirectional check module mounted within the internal space and installed between the connector portion and the dye coating module, and wherein the unidirectional check module comprises at least one backflow-proof filter formed with a plurality of radially arranged incisions.

3. The extension barrel according to claim 2, wherein the at least one backflow-proof filter comprises a convex portion protruding toward the front end of the outer tube.

4. The extension barrel according to claim 2, further comprising an inner tube mounted within the internal space of the outer tube to accommodate the unidirectional check module and the dye coating module, so that the inner tube and the bullet passage tube cooperatively define the dye powder reservoir.

5. The extension barrel according to claim 4, wherein the inner tube comprises an upper half and a lower half, both being formed on the inner walls thereof with recesses for positioning the unidirectional check module and the bullet passage tube, and wherein the upper half is coupled to the lower half by a buckle element.

6. The extension barrel according to claim 5, wherein the buckle element comprises one or more first clip portions and one or more second receiver portions, and wherein the respective first clip portions are received by and engage the respective receiver portions.

7. The extension barrel according to claim 2, wherein the unidirectional check module further comprises a first fastener member and a second fastener member, and wherein the at least one backflow-proof filter is sandwiched in position between the first fastener member and the second fastener member.

8. The extension barrel according to claim 7, wherein the first fastener member is provided with one or more third clip portions and the second fastener member is provided with one or more fourth receiver portions, and wherein the respective third clip portions are received by and engage the respective fourth receiver portions.

9. The extension barrel according to claim 1, wherein the connector portion comprises a base and the through hole is provided with internal threads, whereas the base is provided with external threads for engaging the outer tube.

10. A pneumatic gun, comprising:

a gun body, a trigger pivotally mounted to the gun body, a gun barrel extending from the gun body, and a gas tank installed within the gun body, wherein the trigger is connected to and cooperates with the gun barrel to project bullets; and an extension barrel according to claim 1;

an adapter connecting the extension barrel to a free end of the gun barrel.

11. The pneumatic gun according to claim 10, wherein the adapter comprises two end portions, both being externally threaded, and is formed with a through hole connecting the two end portions.

12. The pneumatic gun according to claim 10, wherein the extension barrel further comprises the unidirectional check module mounted within the internal space and installed between the connector portion and the dye coating module, and wherein the unidirectional check module comprises at least one backflow-proof filter formed with a plurality of radially arranged incisions.

* * * * *